United States Patent [19]

Ginsburgh et al.

[11] 4,343,360

[45] Aug. 10, 1982

[54] METHOD FOR CONTROLLING UNDERGROUND COMBUSTION

[75] Inventors: Irwin Ginsburgh, Morton Grove; Robert D. Hall, Wheaton, both of Ill.

[73] Assignee: Standard Oil Company (Indiana), Chicago, Ill.

[21] Appl. No.: 174,601

[22] Filed: Aug. 1, 1980

Related U.S. Application Data

[62] Division of Ser. No. 925,181, Jul. 17, 1978, Pat. No. 4,271,904.

[51] Int. Cl.[3] ..... E21B 43/247; E21B 47/00

[52] U.S. Cl. ..... 166/251; 166/259

[58] Field of Search ..... 166/250, 251, 256, 259, 166/260, 261, 65 R, 66; 299/2; 208/11 R; 324/1, 9, 10, 62, 65 R, 71

[56] References Cited

U.S. PATENT DOCUMENTS

| | | | |
|---|---|---|---|
| 2,734,579 | 2/1956 | Elkins | 166/58 X |
| 2,803,305 | 8/1957 | Behning et al. . | |
| 3,490,529 | 1/1970 | Parker | 166/256 |
| 3,661,423 | 5/1972 | Garrett | 299/2 |
| 4,082,145 | 4/1978 | Elkington | 166/251 |
| 4,246,965 | 1/1981 | Cha | 166/251 |

*Primary Examiner*—Stephen J. Novosad
*Assistant Examiner*—George A. Suchfield
*Attorney, Agent, or Firm*—Ronald C. Petri; William T. McClain; William H. Magidson

[57] ABSTRACT

Disclosed is a method for controlling the flame front during the in situ combustion of a subterranean carbonaceous stratum which involves monitoring the extent and movement of said flame front to determine the location of one or more segments of the flame front which exhibit unfavorable combustion characteristics, and injecting one or more gases into the vicinity of one or more of said segments to control and optimize the combustion in said segment.

2 Claims, 4 Drawing Figures

METHOD FOR CONTROLLING UNDERGROUND COMBUSTION

This is a division of application Ser. No. 925,181, filed July 17, 1978, now U.S. Pat. No. 4,271,904.

BACKGROUND

1. Field of the Invention

This invention relates to a method of monitoring the progress and pattern of a combustion or flame front being advanced through a combustible subterranean carbonaceous stratum, and thereafter controlling the progress of said flame front. In particular, this invention relates to a method of monitoring both the vertical and lateral movement of an underground flame front and injecting gases into the vicinity of the combustion area to control the flame front. More particularly, this invention relates to a method of monitoring the pattern and spatial orientation of a flame front during in situ retorting of oil shale and injecting and controlling the flow of fuel or fuel gases into the retort to control the speed, extent and uniformity of the flame front in the retort.

2. Related Applications

Subject matter disclosed in this application is also disclosed in commonly assigned U.S. Applications Ser. No. 925,064 , now U.S. Pat. No. 4,167,213, Ser. No. 925,065, now U.S. Pat. No. 4,184,548 Ser. No. 925,176, now U.S. Pat. No. 4,210,867, Ser. No. 925,177, now U.S. Pat. No. 4,210,868, and Ser. No. 925,178, now U.S. Pat. No. 4,199,026; all of said applications filed concurrently herewith and expressly incorporated herein by reference.

3. Description of the Prior Art

The term oil shale refers to sedimentary deposits containing organic materials which can be converted to shale oil. Oil shale contains an organic material called kerogen which is a solid carbonaceous material from which shale oil can be retorted. Upon heating oil shale to a sufficient temperature, kerogen is decomposed and a liquid product is formed.

Oil shale can be found in various places throughout the world, especially in the United States in Colorado, Utah and Wyoming. Some especially important deposits can be found in the Green River formation in Piceance Basin, Garfield and Rio Blanco counties, and northwestern Colorado.

Oil shale can be retorted to form a hydrocarbon liquid either by in situ or surface retorting. In surface retorting, oil shale is mined from the ground, brought to the surface, and placed in vessels where it is contacted with hot retorting gases. The hot retorting gases cause shale oil to be freed from the rock. Spent retorted oil shale which has been depleted in kerogen is removed from the reactor and discarded.

In situ combustion techniques are being applied to shale, tar sands, Athabasca sand and other strata in virgin state, to coal veins by fracturing, and to strata partially depleted by primary and even secondary and tertiary recovery methods.

In situ retorting oil shale generally comprises forming a retort or retorting area underground, preferably within the oil shale zone. The retorting zone is formed by mining an access tunnel to or near the retorting zone and then removing a portion of the oil shale deposit by conventional mining techniques. About 5 to about 40 percent, preferably about 15 to about 25 percent, of the oil shale in the retorting area is removed to provide void space in the retorting area. The oil shale in the retorting area is then rubblized by well-known mining techniques to provide a retort containing rubblized shale for retorting.

A common method for forming the underground retort is to undercut the deposit to be retorted and remove a portion of the deposit to provide void space. Explosives are then placed in the overlying or surrounding oil shale. These explosives are used to rubblize the shale and preferably form rubble with uniform particle size. Some of the techniques used for forming the undercut area and the rubblized area are room and pillar mining, sublevel caving, and the like.

After the underground retort is formed, the pile of rubblized shale is subjected to retorting. Hot retorting gases are passed through the rubblized shale to effectively form and remove liquid hydrocarbon from the oil shale. This is commonly done by passing a retorting gas such as air or air mixed with steam and/or hydrocarbons through the deposit. Most commonly, air is pumped into one end of the retort and a fire or flame front initiated. This flame front is then passed slowly through the rubblized deposit to effect the retorting. Not only is shale oil effectively produced, but also a mixture of off-gases from the retorting is also formed. These gases contain carbon monoxide, ammonia, carbon dioxide, hydrogen sulfide, carbonyl sulfide, and oxides of sulfur and nitrogen. Generally a mixture of off-gases, water and shale oil are recovered from the retort. This mixture undergoes preliminary separation (commonly by gravity) to separate the gases, the liquid oil, and the liquid water. The off-gases commonly also contain entrained dust and hydrocarbons, some of which are liquid or liquefiable under moderate pressure. The off-gases commonly have a very low heat content, generally less than about 100 to about 150 BTU per cubic foot.

One problem attending shale oil production in in situ retorts is that the flame front may "channel" through more combustible portions of the rubble faster than others. The resulting nonuniform or uneven passage of the flame can leave considerable portions of the rubblized volume bypassed and unproductive. Such channeling can result from nonuniform size and density distributions in the rubblized shale. If the shape of the flame front can be defined or packing variations detected within the retort, then channeling and its effects can be mitigated by controlling the air injection rate and oxygen content into various segments of the retort, or by secondary rubblization if regions of poor density can be mapped.

A variety of prior art techniques have been established for determining the position and progress of underground combustion. Various methods have also been employed to control the progress of underground combustion.

The techniques employed to monitor the position and progress of underground combustion range from indirect theoretical mathematical formulations on the one hand, to rather simplistic direct measurements that can be done at the combustion site on the other. One method relates the pressure fall-off observed at the bottom of the well hole of either injected liquid or effluent gases to the approach of the flame front. A second method employs infrared imaging to detect thermal energy from subsurface heat to identify hot portions of the surface terrain. Simple periodic measurements of the elevation of the ground at a variety of points above the path of the combustion front are used to identify portions of the ground that exhibit a slight rise in elevation due to the presence of a combustion front directly under the elevated point.

Fuel packs have been used in which separate masses of gas-forming materials are spaced at predetermined distances. The release of the identifiable gases at spaced intervals can be related to the position of the combustion front in a particular fuel pack. Another method involves an analysis of effluent gases and a correlation between concentration levels of certain gases to the efficiency of the underground combustion. A similar sample-and-analysis technique involves monitoring various physical properties of the fluids which enter a production well for a change in any two properties, thereby signaling the proximity of a combustion front. Thermocouples have also been used to monitor temperature changes of the overburden to ascertain the position of the flame front. This method can also be employed in a down-hole version. Self-potential profiling has been used to detect self-potential voltages generated by the underground combustion. Finally, high frequency electromagnetic probing can be used to observe the progress of the flame front by its effect upon reflected radiofrequency waves .

The methods taught by the prior art are, in general, directed towards either (1) detecting lateral movement of a flame front, or (2) the vertical movement of a flame front, but not both. In addition, even those methods which are capable of detecting the directional movement and location of the front do not provide a means for ascertaining whether the front is tilted out of a desired orientation. Such tilts are undesirable as they can cause incomplete or inefficient combustion in the retort. In general, the prior art does not provide a means of detecting both the lateral and vertical location of a flame front, the speed with which the flame front is propagating through the carbonaceous stratum and the degree to which the front deviates from a desired horizontal or vertical plane. Once these parameters of the underground flame are detected, various means can be employed to selectively speed up or hinder portions of this flame front to more efficiently effectuate the retorting process and eliminate unfavorable combustion characteristics.

A variety of methods have also been employed to control the extent, progress or uniformity of an underground flame front. One method injects an oxygen-containing gas into the formation to produce auto-oxidation of the material and then injecting a second gaseous mixture of oxygen and a combustible gas behind the front to control the speed of the flame front. This causes the combustion zone to spread vertically while the horizontal position remains substantially constant.

A second process useful in inverse-combustion involves injecting a combustion-supporting free-oxygen-gas into an underground stratum to feed the flame front and injecting a transport gas behind the combustion front to transport hydrocarbons into unburned stratum. Other methods similarly involve the injection of various gases either in front of or behind the flame front to speed up, hinder, or optimize combustion.

All of the above methods are notable in that they are applied "blind." That is, assumptions are made concerning the combustion characteristics underground and gases are introduced without specific information as to the actual conditions. This is done in the hope that the gases will achieve the desired purpose. The prior art control techniques are not employed in conjunction with a specific means of monitoring the flame front. All control methods are generalized in nature and not in response to detected anomalies or problem areas in the combustion front. In contrast, this invention provides for monitoring specific characteristics of the flame front and then the application of controlling means in direct response to detected problem areas or anomalies in the flame front. Significant advantages over the "blind" prior art control methods include; higher efficiency in locating and correcting specific unfavorable combustion characteristics; the ability to respond directly to and correct highly localized unfavorable combustion characteristics; the ability to respond more quickly as channeling, for example, occurs to prevent large scale problems; economy in usage of the control apparatus as it will be employed only where needed; and the ability to continuously monitor the flame front response to the control method, and thereby identify areas requiring continued corrective efforts.

The general object of this invention is to provide a method of controlling the progress and pattern of a combustion front of carbonaceous stratum which avoids the random or "blind" nature of prior art techniques. A more specific object of this invention is to provide a method for controlling both the vertical and lateral movement of an underground flame front. Another object of this invention is to provide a means of ascertaining the spatial orientation of the flame front and thereafter controlling the front to optimize combustion yield in a retort.

SUMMARY OF THE INVENTION

The objects of this invention can be achieved through a method for detecting and controlling the flame front during the in situ combustion of a subterranean carbonaceous stratum which involves monitoring the extent (i.e. the location and tilt) and movement of the flame front to determine the location of one or more segments of said flame front which exhibit unfavorable combustion characteristics, and injecting and controlling the flow of one or more gases into the vicinity of one or more of said segments to control and optimize the combustion in said segments.

A number of methods are available to detect and monitor flame front conditions during an in situ combustion process. It is important to choose a detection method which is capable of providing detailed information on all segments of the flame front. In this way, segments of the flame front which are channeling ahead or lagging behind, are the wrong thickness or temperature for favorable combustion, or begin to cause a "tilt" in the flame front plane can be diagnosed with specificity and controlled with accuracy.

Two methods of providing such detailed information on the extent and movement of an underground flame front utilize the fact that the electrical conductivity of a burning layer of material is greater than the conductivity of that same material prior to combustion. The rubblized shale in a retort makes poor electrical coupling with the solid walls of the retort. As the shale burns, however, the flame front becomes a better electrical conductor than both the unburnt rubble and the solid overburden. The net effect at the surface is that the flame front appears to be a plane of electrical conducting material imbedded in the ground, a relative insulator. As the flame front burns through the retort, the conducting layer changes position with respect to the surface.

Coil Method

When a multi-turn coil of wire is made part of a resonant circuit, the resonant frequency of the circuit and coil can be measured. If a conductor is brought into the vicinity of the coil the impedance (a measure of both the resistance and inductance) of the coil, and consequently the resonant frequency of the coil circuit, is altered. This change in impedance or resonant frequency of a coil can be related to the position of the nearby conductor. In general, such coils are sensitive to conductors nearer than a few coil diameters away.

In the simplest configuration, a large diameter multi-turn coil is laid on the surface of the ground above an expected in situ combustion site, such as a retort, and electrically connected to an oscillator, frequency counter, and a means for detecting when electrical resonance occurs in the circuit. Resonant conditions are established in the circuit prior to initiation (or arrival) of the combustion front. The flame front appears to be a large conducting region in comparison with the insulating effects of the overburden and side walls. The presence of this conductor in the proximity of the coil alters the resistance of the coil, and thereby, the resonant frequency of the circuit. The change in impedance and/or resonant frequency of the circuit is monitored as the burn progresses through the retort, and the location of the front relative to the coil can be related to the magnitude of the change in the circuit's electrical characteristics.

The effect of such a flame front on the resonance of a large coil is very small and direct quantitative measurements are generally difficult. Therefore, a method which is sensitive to small changes in the circuit is preferred. This is accomplished through the use of a bridge circuit. A typical bridge circuit may employ two identical coils—one located over the retort or combustion site and another reference coil a sufficient distance away to be unaffected by the combustion. A modified Wheatstone Bridge circuit is established, as shown in FIG. 1, wherein the two coils $C_1$ and $C_2$ are connected in a bridge with two known resistors $R_1$ and $R_2$. A variable resistor $R_3$ and a variable inductor, $L_3$, are connected in series with the coil $C_2$. For purposes of FIG. 1, $C_1$ is the sensing coil located over the flame front and $C_2$ is the reference coil; the roles of the coils may be reversed however without substantially affecting the method. An alternating current is applied across the bridge by G. A sensitive meter, M, is connected into the bridge circuit as shown. In effect, M is a very sensitive galvanometer capable of detecting very small currents. There are four primary junction points in the circuit, labeled 1 through 4 in FIG. 1.

Thus, any change in the effective impedance of any branch of the circuit will result in an imbalance of the bridge and a nonzero current reading at M. One advantage of a bridge circuit is that the sensitivity of the meter M can be chosen such that even a very small change in any branch of the circuit causes a relatively large deflection in M. As a consequence, a weak perturbation of the circuit can be made easily observable at M and distinguishable from all other background factors which do not directly affect the balance of the bridge.

The sensitivity of the coil is an important factor to consider when determining the dimensions of the necessary circuits. As previously noted, the coil can reamin sensitive to the presence of a conductor within a distance of a few coil diameters. Thus, for instance, if it is expected that the overburden for the retort is to be 500 feet, and the height of the retort itself is to be 1000 feet, then the coil should be sensitive to the presence of the flame front as far away as the deepest portion of the carbonaceous stratum to be ignited, or 1500 feet. This would require that the coil have an approximate diameter of 500 feet.

Resistance Probe Method

Under ordinary circumstancs, the electrical resistance of the ground can be expected to be very high. That is, when two resistance probes are placed into the ground some distance apart, the resistance measured between these probes is very high. However, when two resistance probes are placed outside the boundaries of an expected underground combustion site (this can be a retort, a seam of coal or some other feature amenable to in situ combustion techniques) the resistance between the probes shows a marked decrease at the ignition or arrival of the flame front beneath and between the probes. This is due to the fact that the flame front is more capable of conducting an electrical current than its surroundings. In effect, the flame front "shorts out" the initial high resistance between the probes, yielding a resistance measurement reflecting a more conductive path. As the flame approaches the vicinity of the probes, the conductive path length of the current (from one probe, through the ground, through the flame front, to the other probe) decreases, resulting in a decrease in the resistance between the probes—reaching a minimum when the front is just beneath and between the probes. As the flame front recedes, the path length and resistance measurements both increase. The change in electrical resistance between the probes is monitored as the burn progresses and the location of the flame front relative to the probes is related to the magnitude of the change in resistance.

While a flame front becomes a relative conductor when compared to its surroundings, the detected decrease in resistance at the surface of the ground (perhaps hundreds of feet away) is very small and direct quantitative measurements are generally difficult. Therefore, a monitoring method that is sensitive to very small changes in resistance is desirable. A bridge circuit similar to that employed in the Coil Method provides a sensitive detector. A typical bridge circuit may employ a pair of probes as one branch of the bridge. A modified Wheatstone Bridge circuit is established as shown in FIG. 2. A pair of resistance probes P and P' are connected in the bridge circuit with three resistors of predetermined value. A variable resistor $R_3$ is connected in series with the probes P and P'. A current (either direct or alternating) is applied across the bridge by G. A sensitive meter M is connected as shown. M is a very sensitive galvanometer capable of detecting very small currents. There are four primary junction points in the circuit—M is connected across junction points 1 and 2; G is connected across junction points 3 and 4.

A so-called "balance" condition is first attained by adjusting the variable resistor $R_3$ until meter M detects zero current. In this condition, the electrical potential at point 1 is exactly equal to the electrical potential at point 2 and no current is flowing through M's portion of the circuit. The configuration of FIG. 2 will again be recognized as a modification of the familiar Wheatstone Bridge wherein one branch (3-2) contains a pair of resistance probes and a variable resistor.

Accordingly, any change in the effective resistance of any branch of the circuit will result in an imbalance of the bridge and a nonzero current reading at M. As noted previously, an advantage of a bride circuit is that the sensitivity of the meter M can be chosen such that even a very small change in any branch of the circuit causes a relatively large deflection in M. As a consequence, a weak perturbation in the resistance of the circuit can be made easily observable at M and distinguishable from all other background factors which do not directly affect the balance of the bridge.

With reference to both the Coil Method and the Resistance Probe Method, information in more than one dimension is obtained by using bridge circuits in which a detector (a coil or a pair of probes) occupies more than one branch. Such multiple detector bridges provide a means of determining localized anomalies in the flame front. Extending the principle further leads to circuits in which the degree of imbalance in one bridge is compared to the degree of imbalance in one or more other bridges.

The Coil Method and the Resistance Probe Method can be employed to detect the flame front in cases where the combustion is expected to proceed vertically (as in a retort), laterally, or even in cases where the direction of the combustion is erratic or unknown. When placed across the path of a lateral combustion site, the detectors (either coils or pairs of probes) are capable of tracking the approach and recession of the flame front as well as the speed of propagation. In vertical or retort combustion, the probes and coils are capable of monitoring the location, movement and spatial orientation of the flame front.

While these methods have preferable application to monitoring flame fronts in vertical retorts, they are equally applicable to other forms of underground combustion. Flame fronts proceeding horizontally, obliquely to the surface, or in several directions simultaneously can be monitored and tracked with an appropriate choice of single detector, bridged detector, and multiple bridge circuits providing scope and precision tailored to the circumstances.

As these methods are dependent upon the resistivity of the ground, they are of course affected by rainfall, residual moisture in the soil, certain ores, subterranean strata, and horizontal aquifers in the vicinity. Reference readings taken by detectors not directly over the retort or prior to ignition allow these physical "background" factors to be determined and subtracted out to yield a signal related only to the advancing flame front.

To accurately determine the progress of the flame front and to ascertain its depth and tilt as well, it will be necessary to calibrate the circuits at least once using some more conventional detection means. Thus, a direct relationship can be empirically established and formulated between the distance to the flame front in feet and the magnitude of the relevant electrical characteristic being detected.

Transmitter Method

Another method of detecting the position, progress, and orientation of the flame front involves the insertion of radio transmitters in the path of the flame front. For purposes of this method, the term "transmitter" is understood to describe a unit capable of sensing information concerning its surroundings and transmitting this data to some receiving apparatus. Such transmitters may operate in continuous mode, short burst mode, or as transponders—sending data only when interrogated.

An array of radio transmitters, preferably battery powered, are located in the path of a flame front prior to arrival or ignition of the front. Each transmitter is intended to sense and transmit to a receiving station information concerning a variety of properties of the rock or rubble immediately surrounding the transmitter. These properties would include the temperature, pressure (both mechanical and gas), gas flow rate, gas composition ($CO_2$ or $O_2$content, for example), and directional mechanical force. The number of properties each transmitter can sense and determine, and the attendant degree of accuracy, is obviously dependent upon the complexity of the transmitters—and this is theoretically limited only by the expense of the additional sophistication.

In the broadest application the individual units of this method are sacrificial. That is, they are not recovered after the combustion is completed. These units are adequately insulated to withstand the flame front temperatures, and thereby function throughout the duration of the combustion. The simplest units, however, are allowed to be destroyed as they are enveloped by the flame and thereby provide an additional reference point of the flame front's passage by their failure.

This method provides a highly flexible comprehensive system for determining a wide variety of parameters and conditions before, during or after the passage of a flame front. Additional sophistication is added in situations where the devices are chosen to be transponders. In this configuration, the devices respond only to an interrogating signal transmitted from the surface. Battery life is conserved and particular information is obtained from a given transponder on command from the surface. Rationalizing the signals from these transponders by computer provides a clear picture of the conditions within and around the flame front. A slightly less sophisticated embodiment makes each device a simple transmitter continuously transmitting its identification code and whatever data is obtained from its surroundings. Again rationalizing the transmissions through a computer yields comprehensive data on the combustion parameters.

Specialization in the sensing devices is also possible in this method. Each transmitter in this embodiment is placed in an array and designed to detect only one or two parameters. For example, one set of transmitters detect temperature, another detect only pressure and another only flow rate. The information is then correlated and interpreted after reception at the surface. Such specialization has the effect of decreasing the complexity, and therefore the cost, of each individual unit.

This method can be employed to detect the flame front in cases where the combustion is expected to proceed vertically (as in a retort), laterally or even in cases where the direction of the combustion is erratic or unknown. When placed in the path of a lateral combustion front, the transmitters of this invention are capable of tracking the approach and recession of the flame front as well as the speed of propagation. In vertical or retort combustion, the transmitters are capable of monitoring the location, movement and spatial orientation of the flame front.

FIG. 3 schematically depicts an irregularly shaped flame front moving down a vertical retort. The transmitters, 10 through 16, are shown spaced in a regular array within the retort. Such regular configuration for the transmitters is achieved by placement of the transmitters in the retort after rubblization is complete. This is accomplished by hammering a hollow tube through the loose rubble—a process that is quicker and less expensive than boring through the pre-rubbled solid rock.

As each transmitter is designed to sense or measure a variety of parameters concerning its immediate surroundings, the information received from any individual sensor/transmitter is limited to a relatively small portion of the retort volume. As a consequence, it is necessary to accurately determine the exact location of each transmitter so that the individual pieces of information can be assembled and, in aggregate, yield a comprehensive profile of conditions within the retort. In this way, particular transmitters which lie in or very near the flame front 11, 12, 13 are distinguished from transmitters far from the front 14, 15, 16—thereby providing an accurate profile of the flame once all transmitter locations are known.

Knowledge of the location of each transmitter is, of course, most easily obtained when the transmitters are inserted after rubblization as in FIG. 3. It is possible, however, to insert the transmitters into the retort area prior to rubblization. In this case, the transmitters are constructed shockproof and encased in strong protective shells to survive explosive rubblization. The final location of each transmitter after rubblization is then determined by triangulation or by directional ranging of the transmitted signals. Insertion prior to rubblization would involve the potentially expensive process of drilling to the desired depth. In addition, the rigid construction and shock-proofing necessary to enable the transmitters to survive rubblization may also compromise the sensitivity and versatility of the sensors. For these reasons, placement in a predetermined array within the retort after rubblization is preferred.

This type of remote instrumentation could supplement or augment the external probe or coil methods previously described. When used in tandem and correlated, such methods will provide a comprehensive profile of the retort throughout the entire retorting process.

Sound Detection Method

In addition to the electrical characteristics of underground combustion, a flame front also exhibits useful seismic characteristics. The position and inclination of a flaming front being propagated through a rubbled oil shale retort during an in situ combustion is determined by monitoring the flame front's acoustic energy output. The rubbled oil shale retort being monitored in this method is envisioned as a well defined, carefully prepared underground rubbled zone of oil shale surrounded by an undisturbed oil shale deposit. As such, the position and the dimensions of the retort are known. Accordingly, the acoustic energy generated by the flame front present within this burning retort is detected at a plurality of positions which are known relative to the rubbled oil shale retort. From these received signals the position of the source of the acoustic energy, the flame front, is determined.

In one configuration of this method, a pair of matched seismic detector means separated by a fixed known distance are moved through a well bore which has been drilled such as to traverse, at a known distance thereto a sidewall of the retort which was selected because the flame front is intended to pass along this sidewall during the in situ combustion. Preferably, acoustic coupling between detector and well bore should be optimized. Thus, a pair of matched hydrophones are suspended vertically in a liquid-filled well bore drilled essentially parallel to the sidewalls of the retort. In this configuration, the output signals from the pair of matched seismic detectors are led to a differential amplifier and the resulting difference signal is recorded as a function of the position of the pair of detectors in the well bore. As the pair of detectors move past the flame front, a relative minimum in the recorded difference signal will occur which identifies the position of the flame front. Repeating this process in more than one well bore will establish the inclination of the flame front within the retort.

In another configuration of this method, a plurality of seismic detectors are positioned along a line on the earth's surface that is essentially perpendicular to the plane of the underground oil shale retort sidewall. The received acoustic signals are analyzed by means of a receiver-to-receiver cross-correlation to determine time shifts which with the known position of the detectors allows the depth of the flame front to be determined.

In still another configuration, one detector is placed on the earth's surface directly above the flame front in the plane of the retort sidewall and a second detector is placed on the earth'surface displaced to the formation side of the sidewall. Preferably, the second detector is a group of seismometers placed in an arc which is focused at the sidewall. In this configuration, the composite seismic signal from the detectors focused at the retort sidewall is cross-correlated with the single detector signal from above the retort, such that a time shift is determined. This time shift along with an average sonic velocity where combined with the known position of the detectors leads to a determination of the depth or position of the flame front. Again, repeated application of various embodiments or their combination at various sidewalls will resolve in determining the inclination of the fire front.

Seismic Method

The flame front in underground combustion can be expected to reflect and refract a seismic signal differently than the surrounding rock or rubble. The altered reflection/refraction patterns caused by the presence of a flame front are used to monitor the position and inclination of the front in a retort.

As with the Sound Detection Method described above, the position and dimensions of an underground retort are known and the transition from the undisturbed shale to rubbled shale at the sidewalls of the retort represent a significant acoustical interface, i.e., major charge in acoustical impedance.

In this method, a seismic signal is initiated towards a sidewall of the retort along which the flame front within the retort is known to traverse. The position of the initiation of this seismic signal is selected relative to the retort sidewall to satisfy two criteria. It is selected such that the seismic energy being reflected from the formation-retort sidewall interface in the region of said interface other than that region adjacent to the flame front position is predominantly away from the seismic detector means being employed to detect this reflection. Also, the position is selected such that the relative amount of seismic energy being directed to the seismic detector means from the region of the interface adjacent to the flame front position is enhanced by the high temperature induced refraction of the seismic signal occurring in that region. After detecting the reflected seismic signal as a function of time by use of the seismic detector means, the position of the flame front is determined from the reflected seismic energy.

In one configuration of this method, the oil shale retort is an essentially vertical retort having essentially vertical sidewalls and the flame front is intended to be essentially a horizontal plane passing vertically through the retort during in situ combustion. In this embodiment, the seismic signal is initiated at or near the earth's surface at a position to one side of the vertical sidewall such that the angle of incidence of the seismic signal to the sidewall results in predominantly downward reflected seismic energy in a region not adjacent to the flame front. But in the region adjacent to the flame front, the high temperature induced refraction of the seismic signal results in an angle of incidence which approaches zero, thus enhancing the relative amount of seismic energy being reflected back to the surface of the earth.

In another application of this method, the previous described steps are repeated at more than one position relative to the rubbled oil shale retort such that the inclination of the flame front can be determined.

DESCRIPTION OF THE CONTROL METHOD

Figure 1:
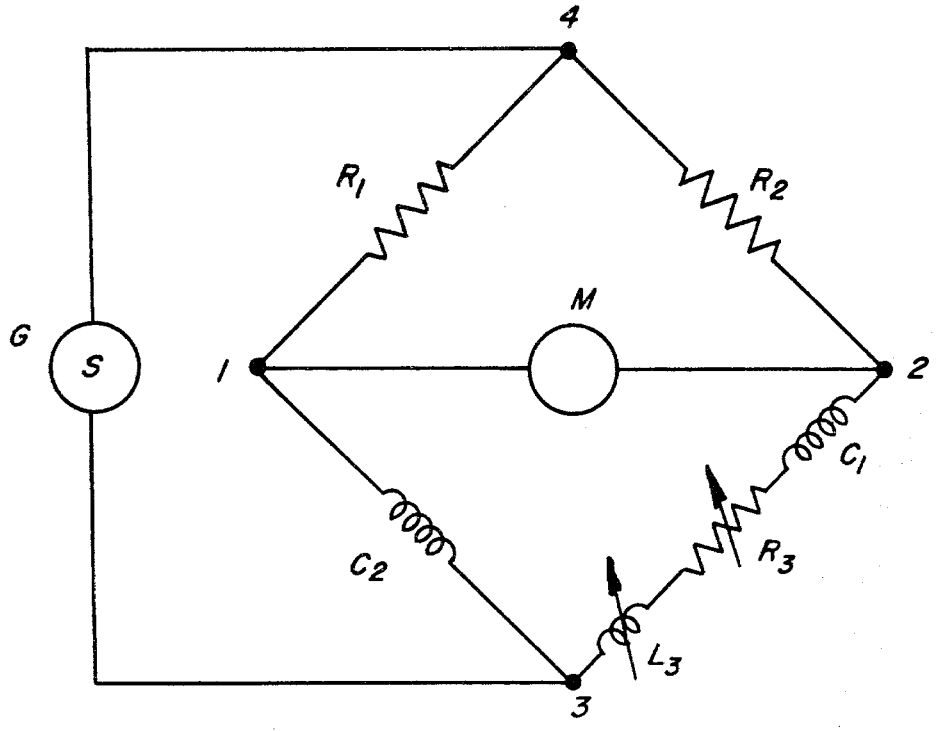
FIG. 1 is a schematic of a modified Wheatstone Bridge Circuit employing coils in 2 branches of the Bridge which is useful in the Coil Method of flame front detection.
Figure 2:
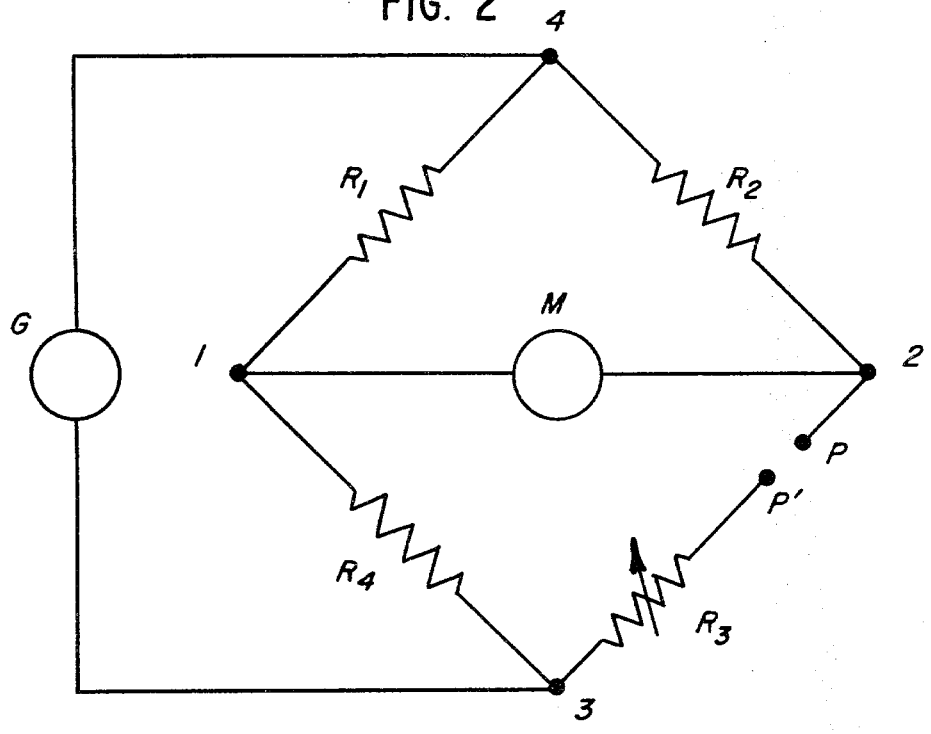
FIG. 2 is a schematic of a modified Wheatstone Bridge Circuit employing a pair of resistance probes in one branch which is useful in the Resistance Probe Method of flame front detection.
Figure 3:
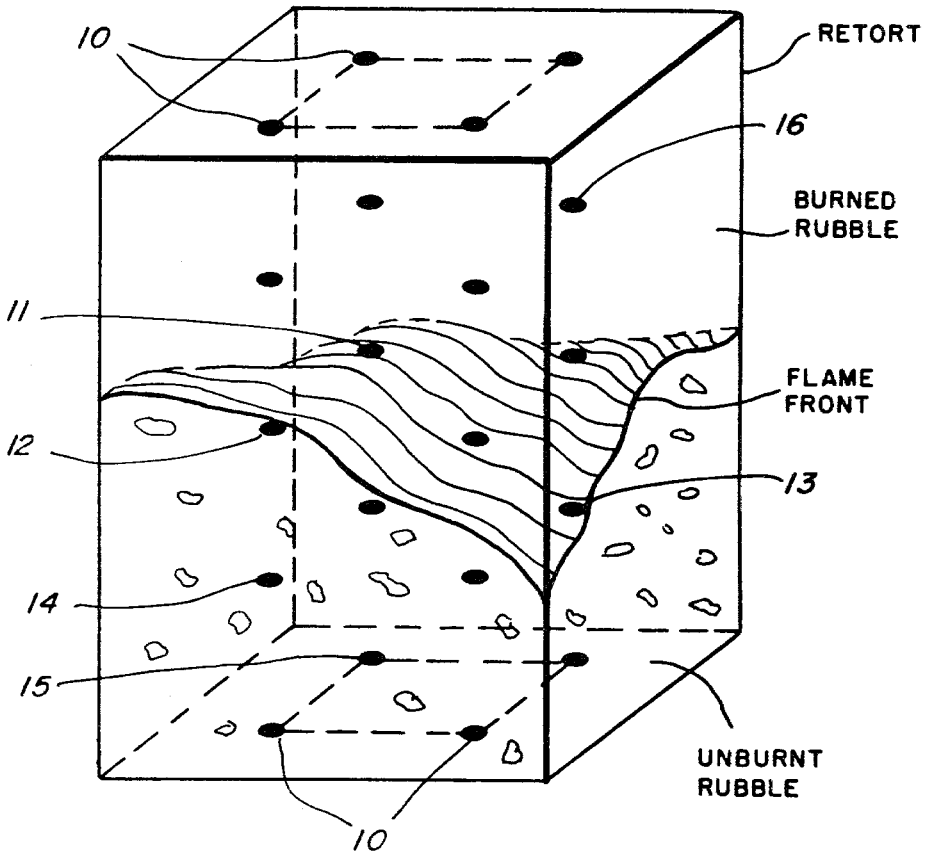
FIG. 3 is a schematic diagram of an array of transmitters located within a retort during combustion which is useful in the Transmitter Method of flame front detection.
Figure 4:
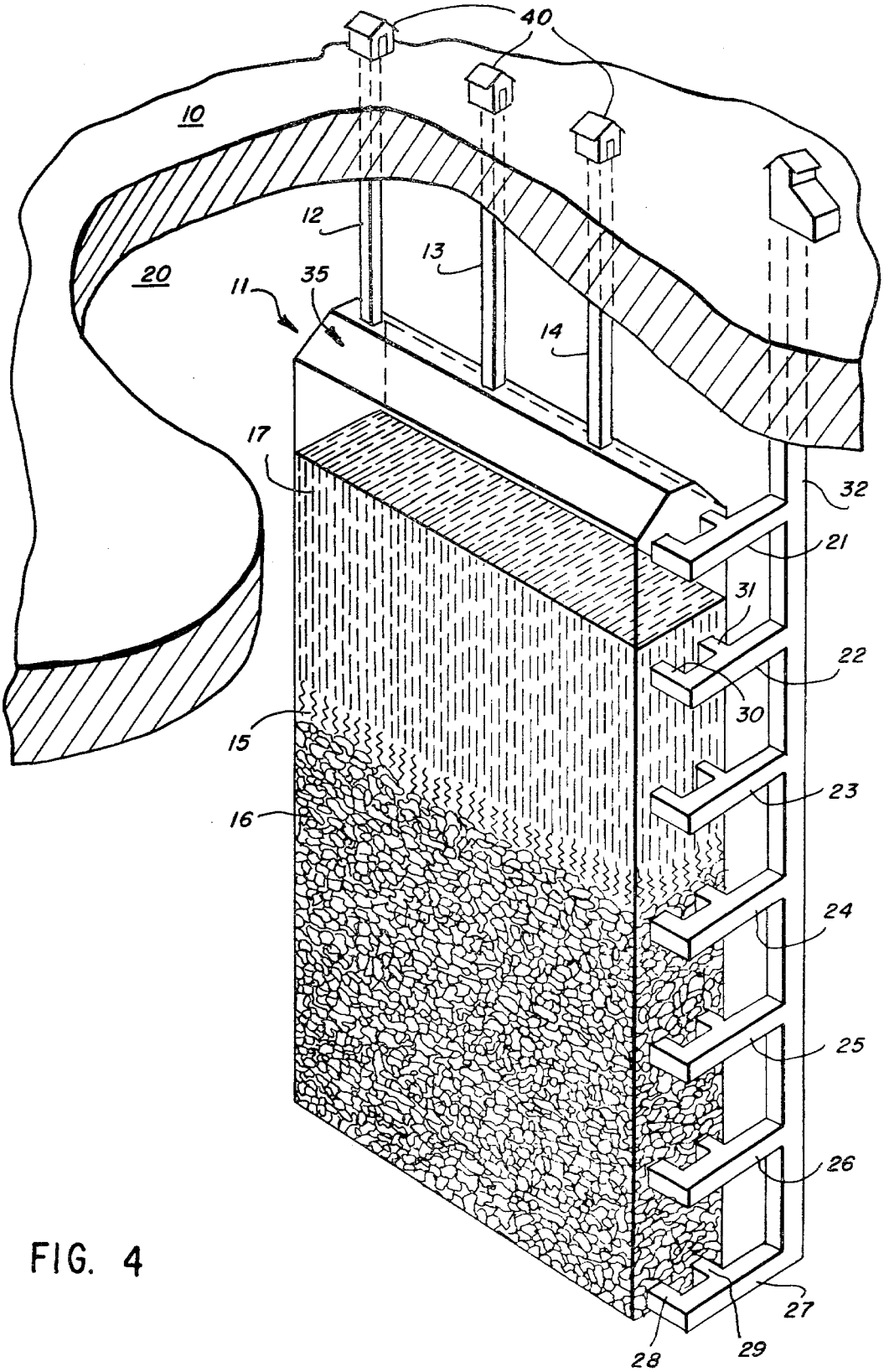
FIG. 4 is a cutaway view illustrating a subterranean oil shale formation containing a rubbled oil shale retort during in situ combustion wherein the flame front and shafts thru which controlling gases can be injected are depicted.

In FIG. 4, there is shown an underground oil shale retort 11 located in an oil shale stratigraphic deposit 20 in which an in situ combustion process to recover liquid and gaseous hydrocarbons is taking place.

The retort is of known dimensions and positions in that it was initially created by mining approximately 20% by volume of the shale deposited within the retort by use of mine shafts 21 through 27 located at various depths. The actual construction of the rubbled retort can be done by conventional mining techniques well known in the art. In general, the respective mine shafts are built with one or more horizontal drifts (e.g. 28, 29, 30, and 31) being driven through the width of the retort. A vertical starting slot to provide a free blasting surface is drilled at the far end of each of the drifts. Fan drilling vertically upward and blasting to create the rubbled zone is performed as the withdrawal from the drift takes place. This process is then repeated on the next lower level until the entire rubbled retort is established. The volume of shale removed, in principal, establishes the net void space (porosity or density) of the resulting retort. The particle size of the rubble is controlled by drilling and blasting parameters with a two foot or less particle size being desirable.

Gases for the in situ combustion are supplied by pumping from the surface 10 through shafts 12, 13, and 14 to the top of the retort 11. During combustion, a horizontal flame front 15 is sustained which moves downward through the rubbled oil shale retort. The hot combustion products from the flame front move downward heating the oil shale to a temperature of about 900° F. which results in kerogen releasing gaseous and liquid hydrocarbons which are then swept downward through the retort leaving a coke-like structure behind. The hydrocarbons are recovered at the lowest level, 27, and are delivered back to the surface via mine shaft 32. Preferably, the hydrocarbon liquid can be separated below the ground (not shown) prior to being pumped to the surface for further treatment. The remaining coke-like material 16 serves as the fuel to sustain the flame front.

As unfavorable combustion characteristics (e.g., channeling, variations or extremes in flame thickness, variations or extremes in combustion temperatures, tilting of the flame front away from a horizontal plane) are detected and monitored in certain segments of the flame front by any of the suitable methods described above, gas shafts 12, 13, and 14 are utilized to control and optimize the burn. Once specific problem areas in the flame front are identified a judicious selection or blend of fuel and diluent gases pumped down the gas shafts from the control houses 40 controls the combustion.

In particular, adding excess fuel gas to the incoming air at the top of a segment of the flame front can be expected to provide extra heat to aid recovery as well as reduce the oxygen available to the flame front, thereby thinning the flame. Such fuel gases can include carbon monoxide, propane, methane, natural gas as well as mixtures of these gases. As such fuel gases will burn preferentially with respect to the shale, the introduction of these gases above a particular segment of the flame is also expected to retard the advance of the flame in that segment.

The addition of diluent or flue gases such as carbon dioxide, nitrogen, steam, off gases from in situ or surface retorting and mixtures of these gases is expected to inhibit combustion. Such gases are most effective, for example, when introduced into the forward edge of an area where channeling is occurring. Such diluent gases are expected to reduce the temperature and impede the progress of the segment of the flame front into which they are injected. In a situation wherein the flame front is tilted, the introduction of diluent gases into the most advanced portion of the flame front will slow its progress and allow the lagging portion to catch up.

The introduction of gases enriched with excess oxygen causes the combustion to proceed more rapidly, thereby increasing the speed of the front. Thus, in the case of a tilted flame front, enriched oxygen injected into the lagging portion will increase the speed of the lagging segment, allowing it to catch up with the remainder.

Consequently, the controlled introduction of combustible gases, non-combustible gases, and enriched oxygen into preselected areas provides for effective control measures in response to detected unfavorable combustion characteristics within the retort. Injecting oxygen behind portions which are to be aided and diluents into and ahead of portions to be hindered provides a means for maintaining the flame front substantially horizontal. More localized problems in the flame front, such as channeling or thickness variations are controlled by an appropriate choice of fuel gases to thin the flame and diluents to impede progress.

Continued monitoring of the flame front profile provides a means of determining the flame front's response to any particular control measure. Segments of the flame front requiring additional control measures are therefore continuously identified.

The degree of control exercised over various segments of the flame front is, of course, dependent upon the efficiency with which the control gas can be made to come into contact with only the areas requiring correction. More selectivity, and therefore more control, can be achieved by increasing the number of shafts through which the control gas may be introduced. Using the drifts 28, 29, 30, 31 to inject control gases also increases efficiency. Moreover, a header system connected into existing shafts 12, 13, and 14 with multiple, but individually valved and controlled, inputs into the retort 11, provides more uniform distribution of the control gases.

It is expected that the pressure of the gas at the injection point is related to the depth to which the gas will penetrate. Once injected into the void space at the top of the retort, the gas will diffuse in roughly a conical pattern with the injection point at the apex and the base approximately equal to the height. This pattern will, of course, be disrupted somewhat upon encountering the spent shale 17. The amount of penetration into the spent shale 17 will be dependent upon the volume of the gas injected, the gas pressure at the injection point and the porosity of the shale. For this reason top injection of the control gases is useful for only the early portion of the combustion—when the flame front is near the top of the retort 11. Side injection through drifts such as 30 and 31 behind the flame front, as well as drifts 28 and 29 ahead of the flame front provides control at later stages of combustion. Therefore, the introduction of such drifts also on the opposing side of the retort 35, is preferred for more effective control.

The concept of using selective and controlled gas injection in conjunction with a number of suitable detection means will usually require processing analysis and correlation of the detected combustion characteristics with the desired control response. This can be done automatically by computer using any of the well known data processing techniques known in the art. Alternatively, the detection means may be monitored manually and the decision of which gases to inject into which segments of the flame front correlated manually between the control houses 40.

Having thus described the various methods of monitoring the combustion characteristics of an underground flame front and a means of responding to detected anomalies to control and optimize the combustion, it should be apparent to one skilled in the art that a number of modifications in details of the embodiments described herein may be made without departing from the scope of the invention. Accordingly the foregoing description is to be construed as illustrative only. It is not to be construed as a limitation upon the invention as defined in the following claims.

We claim:

1. In the in-situ combustion of a subterranean carbonaceous stratum, a method of controlling an underground flame front comprising (a) monitoring the progress and orientation of the flame front in a vertical retort to determine the location of one or more segments of said flame front which exhibit unfavorable combustion characteristics by means of the Resistance Method which comprises:

inserting two or more pairs of resistance probes into the surface of the ground above a vertical retort and outside the sidewall boundaries of said retort, connecting said pairs of probes in an electrical circuit capable of measuring the resistance between pairs of probes wherein the progress, movement and spatial orientation of the flame front in three dimensions within said retort is correlated to the difference between the resistances detected by each pair of probes, and (b) injecting and controlling the flow of one or more gases into the vicinity of one or more of said segments to speed up or retard the combustion in said segment.

2. The method of claim 1 wherein the injection and control of said gases in step (b) is accomplished through a header system connected to the top air shafts of said retort and having a plurality of individually valved and controlled injection points at the top and sides of said retort operated to selectively control segments of the flame front and prevent uneven combustion.

* * * * *